US005754199A

United States Patent [19]

Miki et al.

[11] Patent Number: 5,754,199

[45] Date of Patent: May 19, 1998

[54] IMAGE FORMING APPARATUS AND IMAGE FORMING METHOD

[75] Inventors: Takeo Miki, Tokyo; Tadayoshi Ohno, Kawasaki; Masashi Hiroki, Yokohama, all of Japan

[73] Assignee: Kabushiki Kaisha Toshiba, Kawasaki, Japan

[21] Appl. No.: 618,793

[22] Filed: Mar. 20, 1996

[30] Foreign Application Priority Data

Mar. 23, 1995 [JP] Japan ..... 7-064488

[51] Int. Cl.[6] ..... B41J 2/06

[52] U.S. Cl. ..... 347/55

[58] Field of Search ..... 347/20, 37, 54, 347/55, 87

[56] References Cited

U.S. PATENT DOCUMENTS

| | | | |
|---|---|---|---|
| 4,510,509 | 4/1985 | Horike et al. | 347/55 |
| 5,504,509 | 4/1996 | Kagayama | 347/55 |
| 5,598,195 | 1/1997 | Okamoto et al. | 347/55 |
| 5,619,234 | 4/1997 | Nagato et al. | 347/55 |
| 5,640,189 | 6/1997 | Ohno et al. | 347/141 |

FOREIGN PATENT DOCUMENTS

93/11866 6/1993 WIPO .

*Primary Examiner*—Matthew V. Nguyen
*Attorney, Agent, or Firm*—Foley & Lardner

[57] ABSTRACT

A recording head of an image forming apparatus comprises an insulating base, a plurality of ejection electrodes formed on the base, and an ink tank arranged on the upper surface of the base so as to cover the ejection electrodes. An ejection point at the distal end of each ejection electrode projects outside the ink tank through a slit in the ink tank. A grounded platen roller is provided at a position to sandwich a paper sheet with the ejection electrodes. A bias power supply for applying a bias voltage to a certain ejection electrode selected in accordance with an image signal, and a recording voltage generation section for applying a recording voltage to this ejection electrode are connected to the rear ends of the ejection electrodes. The recording voltage consists of an agglomeration voltage for collecting charged coloring material particles at the selected ejection electrode, and an ejection voltage for ejecting the coloring material particles at the selected ejection electrode. When the recording voltage is applied to the selected ejection electrode upon application of the bias voltage to the ejection electrodes, a high-concentration ink droplet ejects.

16 Claims, 5 Drawing Sheets

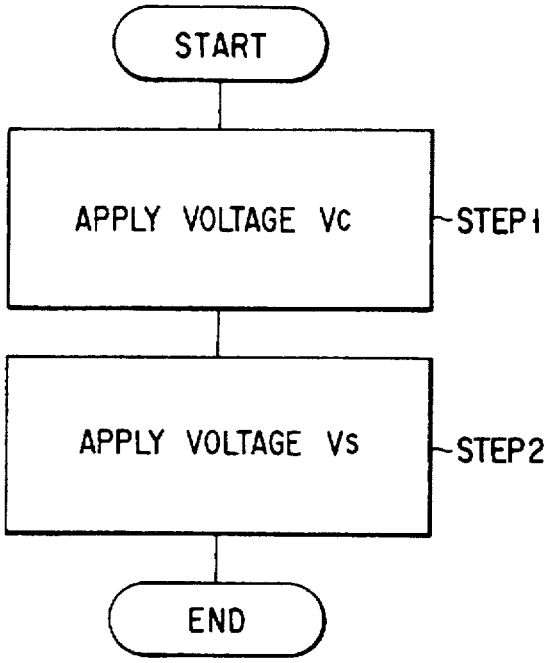
FIG. 3
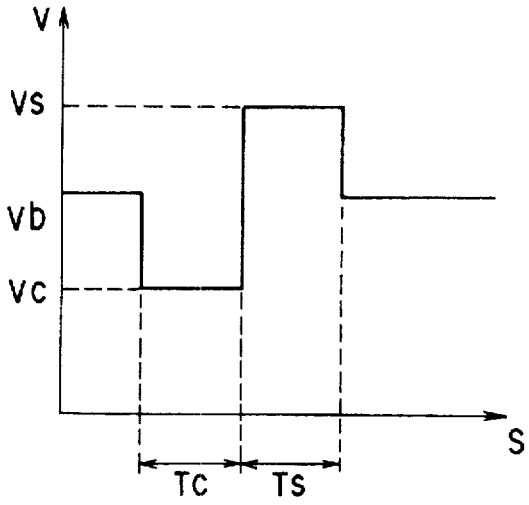
FIG. 4
FIG. 5A
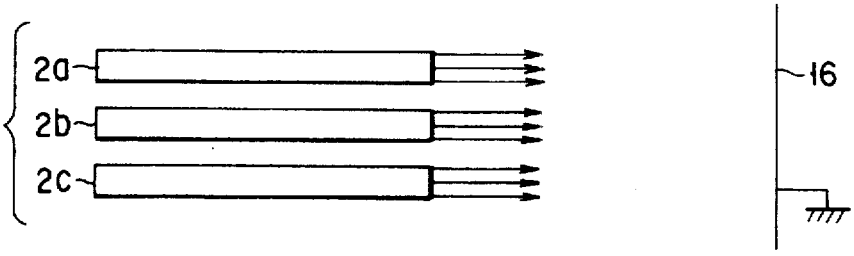
FIG. 5B
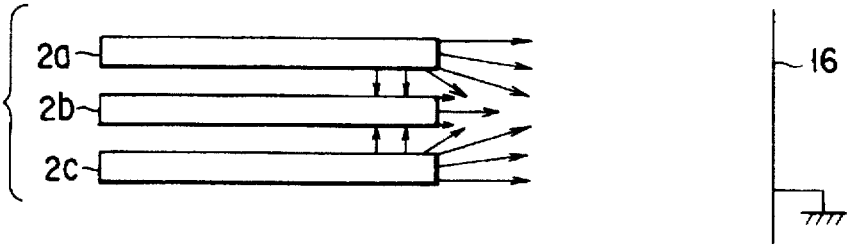
FIG. 5C
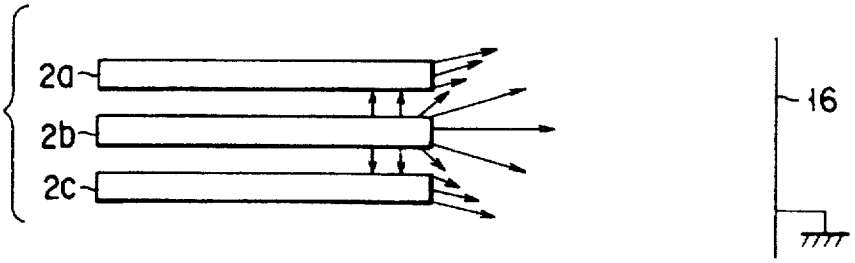

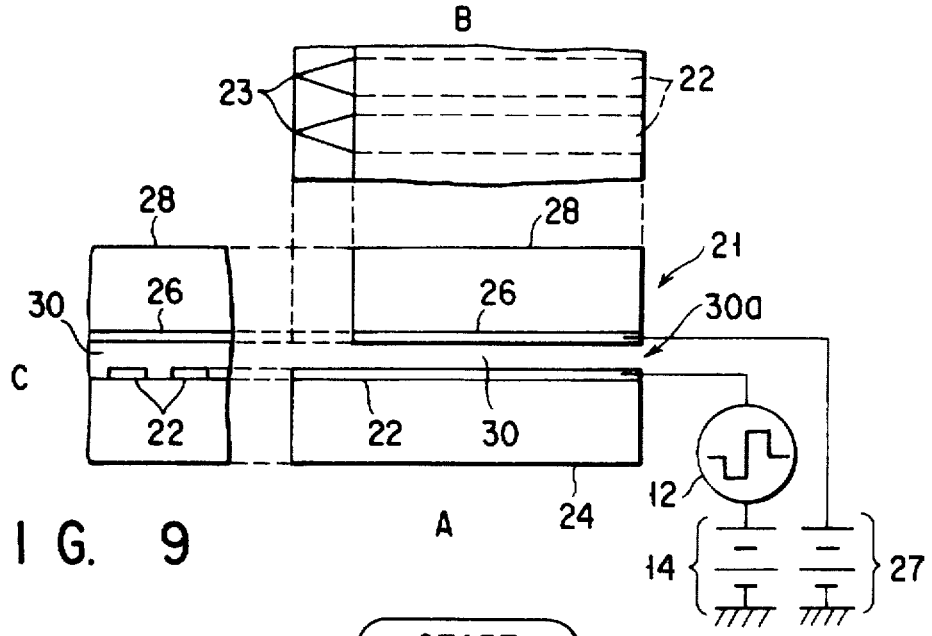
FIG. 9
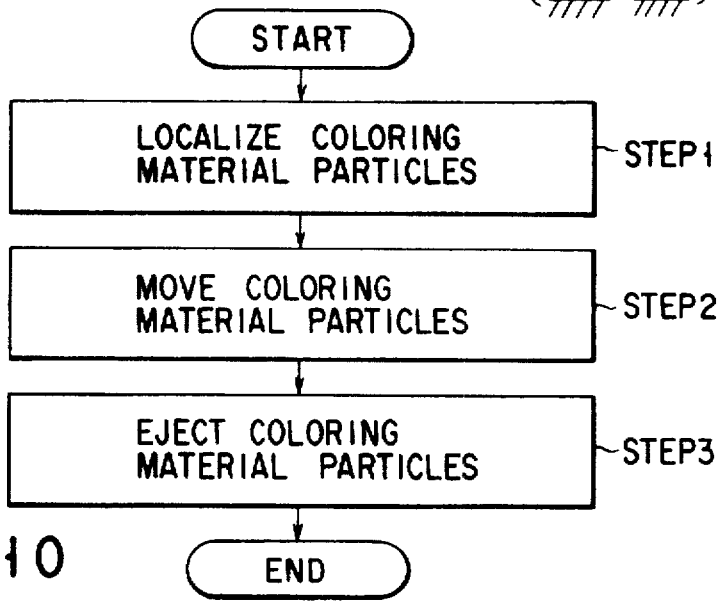
FIG. 10
FIG. 11A
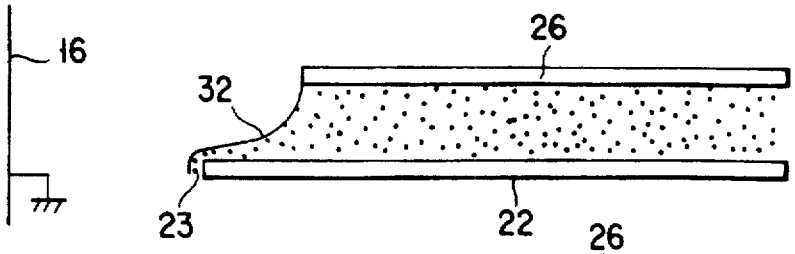
FIG. 11B
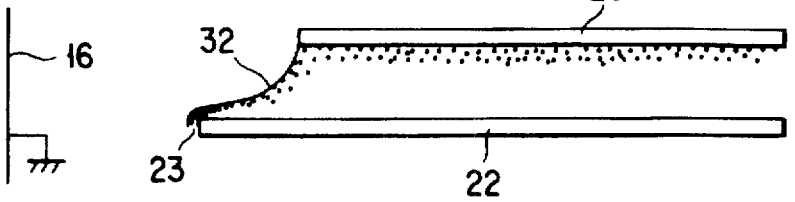

FIG.12A
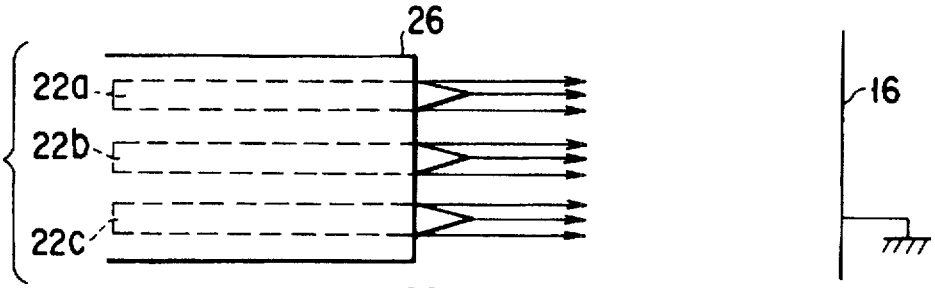
FIG.12B
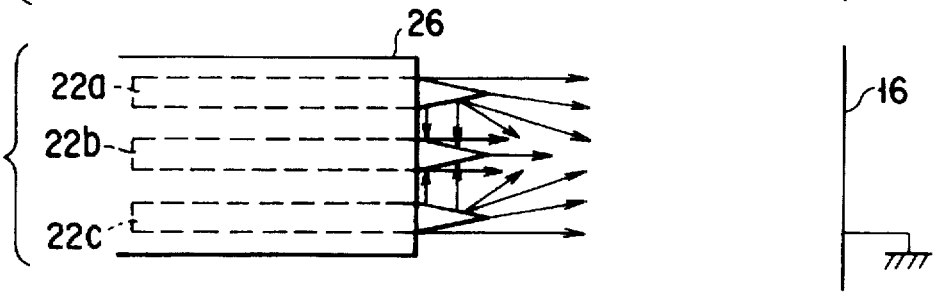
FIG.12C
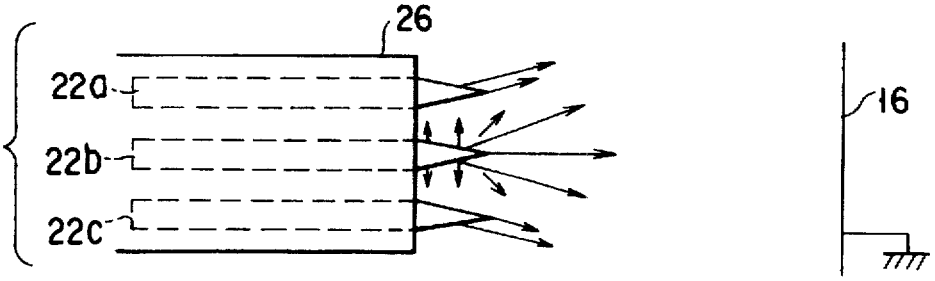
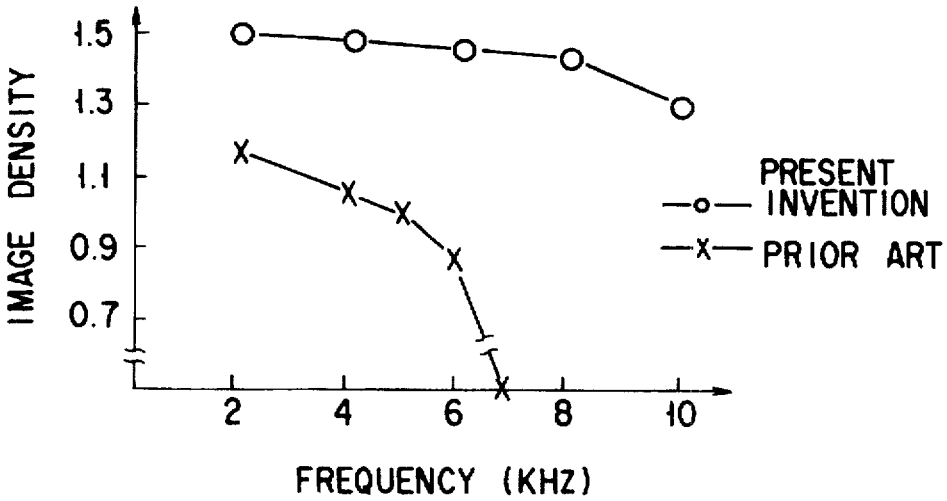
FIG. 13

IMAGE FORMING APPARATUS AND IMAGE FORMING METHOD

BACKGROUND OF THE INVENTION

1. Field of the Invention

The present invention relates to an image forming apparatus and image forming method of forming an image on a recording medium and, more particularly, to an image forming apparatus and image forming method of forming an image by flying an ink prepared by dispersing charged coloring material particles in an insulating liquid, onto a recording medium.

2. Description of the Related Art

In recent years, printers of an ink-jet recording scheme are widely available in the field of personal printers. An ink-jet printer forms an image on a recording medium by flying ink droplets toward the recording medium.

The ink-jet printer disclosed in WO93/11866, first, supplies an ink prepared by dispersing charged coloring material particles within an insulating liquid, to the distal ends of ejection electrodes arranged in accordance with a recording resolution. Then, a predetermined bias voltage of the same polarity as that of the coloring material particles is applied to each ejection electrode, so as to move the particles towards each ejection point. Thus, the particles are concentrated. Subsequently, a recording voltage is selectively applied to those of the ejection electrodes, selected in accordance with a recording signal, and thus the concentrated particles are separated from the insulating liquid and flown towards the recording medium. With the above-described series of steps, an image is formed on the recording medium.

In this case, since the concentration of the coloring material particles to be flown depends on the application time of the bias voltage applied to the ejection electrode, any difference in the application time of the bias voltage causes concentration nonuniformity of the coloring material particles. For this reason, the concentration of the coloring material particles is not stable, and the formed image becomes nonuniform.

In addition, when the recording voltage is applied to a selected ejection electrode, an electric field pointing toward the adjacent ejection electrodes is formed as well as an electric field pointing toward a recording medium set on the counter electrode. Due to the electric field pointing toward the adjacent ejection electrodes, some of the coloring material particles which have moved to the ejection point of the selected ejection electrode move to the adjacent ejection electrodes. For this reason, the concentration of the coloring material particles to be flown decreases. Further, since some coloring material particles move to the adjacent ejection electrodes, a long time is required to move coloring material particles having an electrical charge sufficient for flying, to the ejection point of the selected ejection electrode. Accordingly, it is difficult to obtain a high ejection frequency.

SUMMARY OF THE INVENTION

The present invention has been achieved under the above-described circumstances, and the object thereof is to provide an image forming apparatus and an image forming method, capable of forming a high-density and stable image, and entailing a high ejection frequency.

In order to achieve the above object, the image forming method according to the present invention includes the steps of: supplying an ink prepared by dispersing charged coloring material particles in an insulating liquid, to each of first and second ejection electrodes arranged to be adjacent to each other and to face a counter electrode on which a recording medium is placed; aggregating the coloring material particles in a vicinity of the first ejection electrode by forming a first electric field between the first ejection electrode and the second ejection electrode supplied with the ink in the supplying step respectively, the first electric field directed from the second ejection electrode toward the first ejection electrode; and ejecting the coloring material particles aggregated in the vicinity of the first ejection electrode in the aggregating step, towards the recording medium by forming a second electric field between the first ejection electrode and the counter electrode.

In the above image forming method, the ink prepared by dispersing charged coloring material particles in an insulating liquid, is supplied to each of the first and second ejection electrodes arranged to be adjacent to each other. Then, the first electric field is directed from the second ejection electrode towards the first ejection electrode, so as to collect the coloring material particles in the vicinity of the first ejection electrode. Further, the second electric field directed from the first ejection electrode toward the counter electrode is created so as to eject the coloring material particles collected in the vicinity of the first ejection electrode, towards the recording medium.

As described above, the coloring material particles are once aggregated in the vicinity of the first ejection electrode so as to sufficiently increase the concentration of the coloring material particles with respect to the first ejection electrode, and then the aggregated particles are ejected towards a recording medium. Consequently, the density of an image formed on the recording medium is increased. Further, since the coloring material particles are once aggregated before being ejected, coloring material particles having a necessary charge amount for ejecting can be collected in a short period of time, and therefore a high ejection frequency can be achieved.

Further, the image forming method according to the present invention includes the steps of: supplying an ink prepared by dispersing charged coloring material particles in an insulating liquid, to each of first and second ejection electrodes arranged to be adjacent to each other and to face a counter electrode on which a recording medium is placed; a first aggregating step for collecting the coloring material particles at one end of each of the first and second ejection electrodes supplied with ink in the supplying step, respectively, by forming a first electric field, the first electric field directed from the first and second ejection electrodes toward the counter electrode; a second aggregating step for collecting the coloring material particles in a vicinity of the first ejection electrode, by forming a second electric field between the first ejection electrode and the second ejection electrode, the second electric field directed from the second ejection electrode toward the first ejection electrode; and ejecting the coloring material particles collected in the vicinity of the end of the first ejection electrode in the first and second aggregating steps, towards the recording medium by forming a third electric field between the first ejection electrode and the counter electrode.

In the above image forming method, the ink prepared by dispersing charged coloring material particles in an insulating liquid, is supplied to each of the first and second ejection electrodes arranged to be adjacent to each other. Then, the first electric field is directed from the first and second ejection electrodes towards the counter electrode, so as to collect the coloring material particles on the end portions of the first and second ejection electrodes. Next, the second electric field directed from the second ejection electrode toward the first ejection electrode is created so as to collect coloring material particles near the end portion of the first ejection electrode. Further, the third electric field is directed from the first ejection electrode towards the counter electrode, so as to eject the coloring material particles collected in the vicinity of the end portion of the first ejection electrode, towards the recording medium.

As described above, the coloring material particles are further aggregated in the vicinity of the first ejection electrode after collecting coloring material particles on the end portions of the first and second ejection electrodes. Therefore, the particle agglomeration efficiency can be further enhanced, and the particle ejection frequency can be further increased.

The image forming apparatus according to the present invention includes: a plurality of ejection electrodes arranged in parallel to each other, each having an ejection point situated to be spaced apart from a recording medium by a predetermined distance; ink supply means for supplying an ink prepared by dispersing charged coloring material particles in an insulating liquid, to the each ejection point; first bias voltage apply means for applying a first bias voltage having a same polarity as that of the coloring material particles, to the plurality of ejection electrodes; second bias voltage apply means for applying a second bias voltage which is lower than the first bias voltage to one of the plurality of ejection electrodes, which is selected in accordance with an image signal, so as to collect the coloring material particles in a vicinity of the selected one of ejection electrodes; and third bias voltage apply means for applying a third bias voltage which is higher than the first bias voltage to the selected one of ejection electrodes, so as to eject the collected coloring material particles towards the recording medium.

In the above image forming apparatus, the ink prepared by dispersing charged coloring material particles in an insulating liquid, is supplied to the ejection point of each of a plurality of ejection electrodes arranged to be apart from a recording medium by a predetermined distance. Then, the first bias voltage having the same polarity as that of the coloring material particles is applied to each of the ejection electrodes, so as to created an electric field directed from the ejection point of each ejection electrode towards the recording medium. Thus, the coloring material particles are collected at each ejection point. Next, the second bias voltage which is lower than the first bias voltage is supplied to those of the ejection electrodes, selected in accordance with an image signal, and coloring material particles are collected to the selected ejection electrode (the ejection point). Further, the third bias voltage which is higher than the first bias voltage is applied to the selected ejection electrode so as to created a strong electric field directed from the selected ejection electrode to the recording medium. Thus, the collected coloring material particles are ejected towards the recording medium.

As described above, the coloring material particles are once aggregated in the ejection points of all the ejection electrodes, and particles are further collected to those of the electrodes, selected in accordance with the image signal, so as to sufficiently increase the concentration of the coloring material particles with respect to the selected ejection electrode. Then, the aggregated particles are ejected towards a recording medium. Consequently, the density of an image formed on the recording medium is increased. Further, since the coloring material particles are once aggregated very efficiently before being ejected, coloring material particles having a necessary charge amount for ejecting can be collected in a short period of time, and therefore a high ejection frequency can be achieved.

The image forming apparatus according to the present invention, includes: ink supply means for supplying an ink prepared by dispersing charged coloring material particles in an insulating liquid, to each of first and second ejection electrodes arranged to be adjacent to each other and to face a counter electrode on which a recording medium is placed; agglomeration means for aggregating the coloring material particles in a vicinity of the first ejection electrode, by forming a first electric field between the first ejection electrode and the second ejection electrode, supplied with the ink by the ink supply means respectively, the first electric field directed from the second ejection electrode toward the first ejection electrode; and ejecting means for ejecting the coloring material particles aggregated in the vicinity of the first ejection electrode by the agglomeration means, towards the recording medium by forming a second electric field between the first ejection electrode and the counter electrode.

The image forming apparatus according to the present invention includes: ink supply means for supplying an ink prepared by dispersing charged coloring material particles in an insulating liquid, to each of first and second ejection electrodes arranged to be adjacent to each other and to face a counter electrode on which a recording medium is placed; first agglomeration means for collecting the coloring material particles at one end of each of the first and second ejection electrodes supplied with ink by the ink supply means, respectively, by forming a first electric field, the first electric field directed from the first and second ejection electrodes toward the counter electrode; second agglomeration means for collecting the coloring material particles in a vicinity of the first ejection electrode, by forming a second electric field between the first ejection electrode and the second ejection electrode, the second electric field directed from the second ejection electrode toward the first ejection electrode; and ejecting means for ejecting the coloring material particles collected in the vicinity of the end of the first ejection electrode by the first and second agglomeration means, towards the recording medium by forming a third electric field between the first ejection electrode and the counter electrode.

Additional objects and advantages of the invention will be set forth in the description which follows, and in part will be clear from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 3 is a flow chart for explaining the operation of the recording head in FIGS. 1A and 1B;

FIG. 4 is a graph showing a recording voltage to be applied to the recording head in FIGS. 1A and 1B;

FIGS. 5A, 5B, and 5C are views for explaining the flying operation of ink droplets in the recording head in FIGS. 1A and 1B;

FIG. 9 includes schematic views A, B and C showing a recording head and its peripheral units according to the second embodiment of the present invention;

FIG. 10 is a flow chart for explaining the operation of the recording head in the schematic views A, B and C of FIG. 9;

FIGS. 11A and 11B are views for explaining step 1 in FIG. 10;

FIGS. 12A, 12B, and 12C are views for explaining steps 2 and 3 in FIG. 10; and

FIG. 13 is a graph showing the relationship between the ejection frequency and the image density in the recording head in FIG. 9.

DETAILED DESCRIPTION OF THE PREFERRED EMBODIMENTS

An embodiment of the present invention will be described below in detail with reference to the accompanying drawings.

Figure 1A:
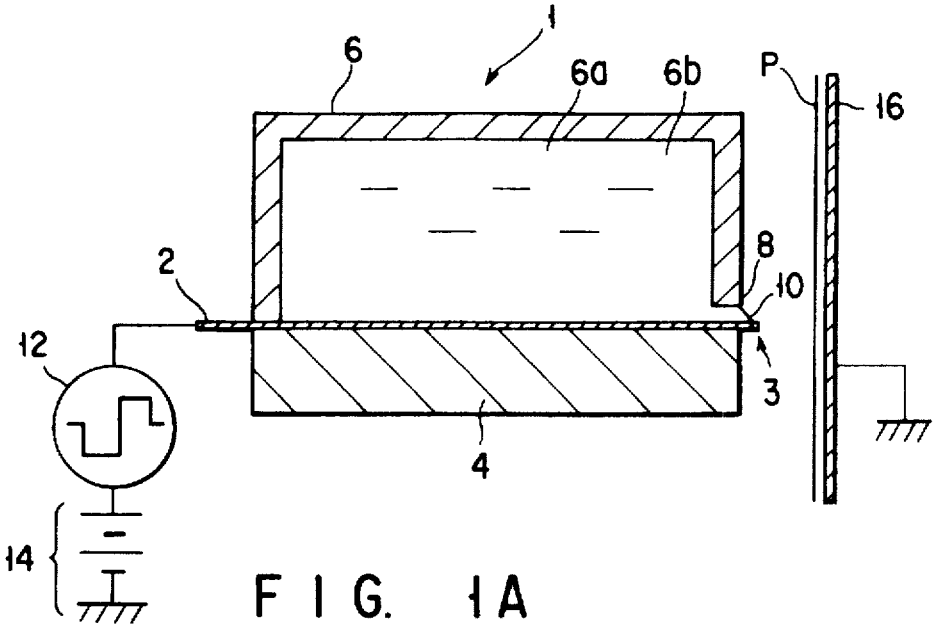
FIG. 1A is a schematic view showing a recording head and its peripheral units according to the first embodiment of the present invention.
Figure 1B:
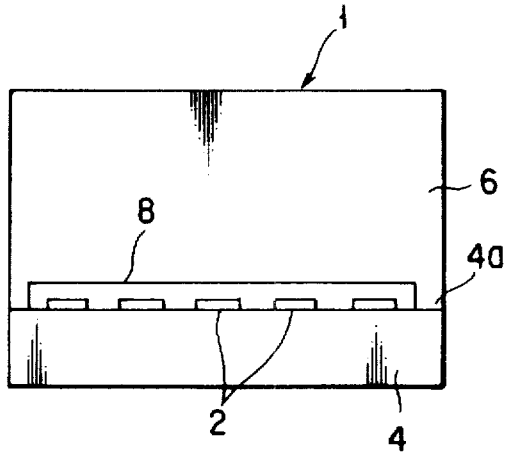
FIG. 1B is a front view showing the recording head in FIG. 1A.

FIGS. 1A and 1B show main part of an image forming apparatus according to the first embodiment of the present invention, respectively. The image forming apparatus comprises a recording head 1. The recording head 1 comprises an insulating base 4, a plurality of ejection electrodes 2 formed on an upper surface 4*a* of the base 4, and an ink tank 6 arranged on the upper surface 4*a* of the base 4 so as to cover the ejection electrodes 2. The ink tank 6 is adhered to the upper surface 4*a* of the base 4 with its end faces aligned with the end faces of the base 4 to constitute an ink container 6*a* together with the base 4. The ink container 6*a* contains an ink 6*b*.

The number of ejection electrodes 2 corresponds to the recording resolution. The ejection electrodes 2 are aligned parallel to each other on the upper surface 4*a* of the base 4 while being electrically independent from each other. The ejection electrodes 2 respectively have distal ends at which ejection points 3 are formed, and are disposed with their distal ends lined up so as to align the ejection points 3 on a straight line. Although FIG. 1B shows 5 ejection electrodes 2 for the purpose of simplicity, 64 ejection electrodes 2 are arranged on one base 4 in this embodiment.

The distal end portion (ejection point 3) of each ejection electrode 2 projects from the distal end faces of the base 4 and the ink tank 6 through a slit 8 (to be described later) formed in the ink tank 6. The proximal end portion of each ejection electrode 2 extends through the ink tank 6 to project from the rear end faces of the base 4 and the ink tank 6. A recording voltage generation section 12 and a bias power supply 14, for applying a predetermined potential to each ejection electrode 2, are connected to the proximal end portion of the ejection electrodes 2 through an IC (not shown). Note that the recording voltage generation section 12 functions as an agglomeration means, second agglomeration means, ejecting means, or second or third bias voltage application means of the present invention, while the bias power supply 14 functions as a first agglomeration means or first bias voltage application means of the present invention. The connection point between the recording voltage generation section 12 and the bias power supply 14, and each ejection electrode 2 is arranged outside the ink tank 6.

Figure 2:
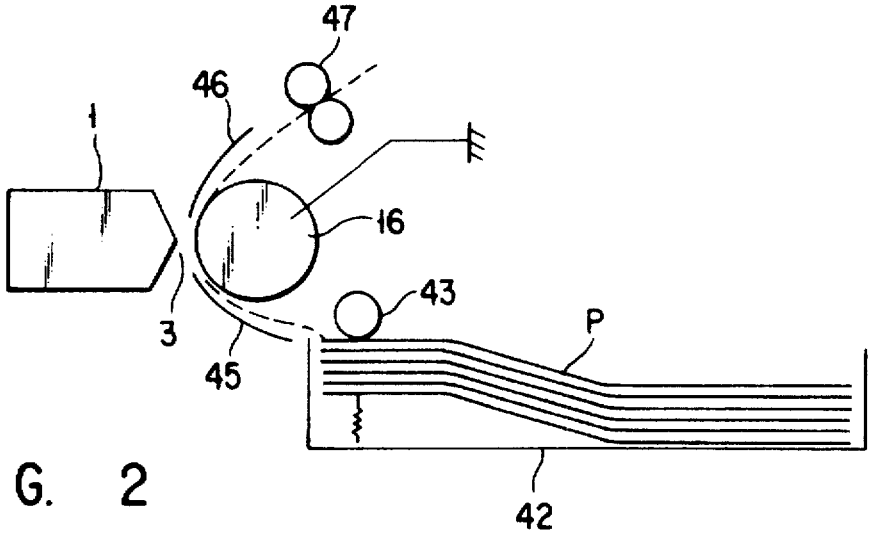
FIG. 2 is a schematic view showing an apparatus for supplying a paper sheet P.

As shown in FIG. 2, a platen roller 16 serving as both a support member for a recording medium (paper sheet P) and a counter electrode is arranged at a position opposite to the recording head 1, i.e., a position opposite to the ejection points 3 of the ejection electrodes 2. In FIG. 1A, the platen roller 16 is represented as a flat plate for the purpose of simplicity. The platen roller 16 is grounded to form a predetermined electric field between the platen roller 16 and the ejection electrodes 2 of the recording head 1. The paper sheet P is interposed between the platen roller 16 and the ejection points 3 while being placed around the circumferential surface of the platen roller 16. Note that, in this embodiment, the distance between the distal portion of each ejection electrode 2, i.e., the ejection point 3 and the platen roller 16 is set at 0.5 mm.

Paper sheets P are contained in a cassette 42 and supplied by a pickup roller 43 one by one. The fed paper sheet P is sent between the recording head 1 and the platen roller 16 along a guide 45, and sandwiched between a convey roller pair 47 along a guide 46. From this state, the paper sheet P is conveyed by the convey roller pair 47 at a constant speed.

The slit 8 is formed in the distal end wall of the ink tank 6, and a proper amount of ink is supplied to the distal end portions of the ejection electrodes 2 through the slit 8. The ink tank 6 has a supply port (not shown) for replenishing ink from an ink supply apparatus (not shown) into the ink tank 6, and an exhaust port (not shown) for exhausting the ink. The slit 8 is formed over a range exceeding the total width of the plurality of ejection electrodes 2 which are aligned horizontally. Therefore, the ink in the ink tank 6 is supplied to the distal end portions (ejection points 3) of the ejection electrodes 2 through the slit 8 to form an ink meniscus 10 at each distal end portion.

The above ejection electrodes 2 are formed as follows. First of all, an electrically insulating polyimide film is prepared, and an elongated hole is formed at substantially the center (position corresponding to the distal end portions of the ejection electrodes 2) of this polyimide film. After a copper foil film having a thickness of about 18 μm is attached to this film, a photoresist layer is applied thereon and exposed through a mask having a predetermined electrode pattern. The exposed photoresist layer is developed to form a photoresist pattern for the ejection electrodes 2. The resultant structure is etched to form a stripe electrode pattern corresponding to the ejection electrodes 2. The film is cut at the center of the hole along the longitudinal direction to form a pair of electrode films on which a plurality of ejection electrodes 2 are aligned.

This electrode film is placed on a base 4 using an alumina plate having a thickness of about 1 mm, and attached thereto so as to allow the distal end portions of the ejection electrodes 2 to project from an end face of the base 4. In this embodiment, 64 ejection electrodes 2 are formed on the base 4 at a density of 8 electrodes/mm (accordingly, the total width of the electrodes is 8 mm).

After the ejection electrodes 2 are formed on the base 4 in the above manner, an ink tank 6 is attached to the base 4 to form a recording head 1. In this case, the size of a slit 8 of the ink tank 6 is determined corresponding to the total width (8 mm) of the ejection electrodes 2. In this embodiment, the slit 8 is about 0.1 mm in height and about 10 mm in width.

The distal end portions of the ejection electrodes 2 need not project from the end face of the base 4, unlike the above description, and may be uniformly aligned with the end face of the base 4. When a recording head in which the distal end portions of ejection electrodes 2 are aligned with an end face of a base 4 is to be formed, a metal such as aluminum or gold is vapor-deposited to a predetermined thickness on an alumina plate which constitutes the base 4. A photoresist layer is applied thereon and exposed through a mask having a predetermined electrode pattern. Next, the exposed photoresist layer is developed to form a photoresist pattern. The metal layer is etched through this photoresist pattern to form a plurality of electrode pattern. The alumina plate is cut at a predetermined position across the plurality of electrode patterns, thereby obtaining a pair of electrode plates in which the distal end portions of ejection electrodes 2 are aligned with the end face of the alumina plate. An ink tank 6 is attached to this electrode plate to form a recording head 1.

Note that the ink **6*b* contained in the above ink container 6*a* is formed by dispersing charged coloring material particles in an insulating liquid such as a petroleum solvent. This ink includes a coloring pigment, such as carbon black, which is contained in a binder consisting of a resin or wax or is attached to the surface of the binder, a dispersant, a charge control agent, and the like. The coloring material particles dispersed in the ink are charged or chargeable to the same polarity as that of the potential to be applied to the ejection electrodes 2**. In this embodiment, the coloring material particles are positively charged in advance.

Next, the recording operation of the recording head 1 having the above arrangement will be described with reference to FIGS. 3 to 5.

The ink **6*b* containing the positively charged coloring material particles is supplied from the ink supply apparatus (not shown) into the ink tank 6 by a hydrostatic pressure or a low-pressure pump through the supply port (not shown). The ink 6*b* contained in the ink tank 6 flows into the slit 8 to form an ink meniscus 10 at the distal end portion of each ejection electrode 2 due to the influences of the effluent pressure of the ink, the opening height of the slit 8**, the surface tension of the ink, and the like.

A bias voltage Vb (first bias voltage) is applied from the bias power supply 14 to all the ejection electrodes 2. At each ejection point 3, the strongest electric field is generated in a direction perpendicular to the surface of the platen roller 16, i.e., a direction indicated by arrows in FIG. 5A because the distance between the distal end portion (ejection point 3) of each ejection electrode 2 and the platen roller 16 is shortest at the ejection point 3. Although a weak electric field is generated between each two adjacent ejection electrodes 2, this electric field is substantially negligible because the electrodes are very thin with respect to the distance between the electrodes. In addition, since the coloring material particles are positively charged, the particles electrostatically repulse with the bias-voltage-applied ejection electrodes 2 to form a concentration gradient in which the concentration of the coloring material particles becomes high in the region between the two adjacent electrodes.

The bias voltage Vb applied to the ejection electrodes 2 is set to be such a value that the electrostatic attraction force from the platen roller 16 which acts on the coloring material particles at each ejection point 3 becomes smaller than the surface tension of the insulating liquid serving as the ink solvent. For this reason, even if the bias voltage is applied to the ejection electrodes 2, the coloring material particles do not fly from the insulating liquid, i.e., the ink.

After the bias voltage Vb is applied to all the ejection electrodes 2 in the above manner, a recording voltage is applied from the recording voltage generation section 12 to a certain ejection electrode 2 selected in accordance with an image signal. When the recording voltage is to be applied to the ejection electrode 2 selected in accordance with the image signal, as represented in step 1 in FIG. 3, an agglomeration voltage Vc (second bias voltage) lower than the bias voltage Vb is applied to the selected ejection electrodes 2 with a predetermined pulse width. Immediately after this application, as represented in step 2, an ejection voltage Vs (third bias voltage) higher than the bias voltage Vb is applied to the selected ejection electrodes 2 with a predetermined pulse width.

For example, a recording voltage as shown in FIG. 4 is formed in the recording voltage generation section 12 by a method (to be described later). This recording voltage is applied to the ejection electrode 2 selected in accordance with the image signal. In this case, it is preferable that an application time Tc of the agglomeration voltage Vc be equal to or longer than an application time Ts of the ejection voltage Vs ($Tc \geqq Ts$), and the voltage difference Vb−Vc between the bias voltage Vb and the agglomeration voltage Vc be equal to or larger than the voltage difference Vs−Vb between the bias voltage Vb and the ejection voltage Vs.

In this embodiment, the recording voltage is set such that the bias voltage Vb=1 kV, the agglomeration voltage Vc=0.5 kV, the ejection voltage Vs=1.5 kV, the application time Tc of the agglomeration voltage=60 μs, the application time Ts of the ejection voltage=40 μs, and the energization period of the recording voltage is set to 5 kHz. Therefore, the application time of a pulse of the recording voltage constituted by a pulse of the agglomeration voltage Vc (agglomeration pulse) and a pulse of the ejection voltage Vs (ejection pulse) is 50% one energization period (200 μs) of the recording voltage.

The recording operation will be described below with reference to FIG. 5 by exemplifying a case in which the above recording voltage is selectively applied to the central ejection electrode **2*b* of three juxtaposed ejection electrodes 2*a*, 2*b*, and 2*c*. Note that the ejection electrode 2*b* at the center functions as the first ejection electrode of the present invention. First of all, a 1-kV bias voltage Vb is applied to the ejection electrodes 2*a* to 2*c* to generate an electric field from the ejection points 3 toward the platen roller 16, as shown in FIG. 5A. When a 0.5-kV agglomeration voltage Vc is applied to the ejection electrode 2*b* with the 60-μs pulse width, an electric field is formed toward the ejection electrode 2*b* from the adjacent ejection electrodes 2*a* and 2*c*, as shown in FIG. 5B. The coloring material particles move to the ejection electrode 2*b* along this electric field. That is, when an agglomeration voltage Vc (0.5 kV) smaller than a bias voltage Vb (1 kV) is applied to the ejection electrode 2*b*, the potential of the ejection electrode 2*b* becomes lower than that of the adjacent ejection electrode 2*a* or 2*c***. An electric field pointing toward the central ejection electrode 2b from the adjacent ejection electrodes 2a and 2c is generated. Accordingly, the positively charged coloring material particles are forced to move toward the low-potential ejection electrode 2b and collect at the ejection electrode 2b.

Immediately thereafter, an ejection voltage Vs (1.5 kV) is applied to the ejection electrode 2b to generate a strong electric field from the ejection electrode 2b toward the platen roller 16, as shown in FIG. 5C. Due to this strong electric field, the coloring material particles move to the distal end portion of the ejection electrode 2b. Once an electrostatic force expressed by the product of the electrical charge of the coloring material particles collected at the distal end portion and the formed electric field exceeds the surface tension of the ink, an ink droplet forms and flies from the ejection point 3 toward the platen roller 16.

In this case, some of the coloring material particles at the ejection electrode 2b move toward the adjacent ejection electrodes 2a and 2c. In this embodiment, however, since coloring material particles have aggregated at the ejection electrode 2b in advance upon application of the agglomeration voltage Vc, the concentration of the coloring material particles at the ejection electrode 2b does not decrease to keep high the concentration of the coloring material particles in the ink droplet to fly. In this embodiment, particularly, the voltage difference Vb−Vc between the agglomeration voltage Vc and the bias voltage Vb is set to be equal to or larger than the voltage difference Vs−Vb between the ejection voltage Vs and the bias voltage Vb, and the application time Tc of the agglomeration voltage Vc is set to be equal to or longer than the application time Ts of the ejection voltage Vs. For this reason, the number of coloring material particles that aggregate to the central ejection electrode 2b from the adjacent ejection electrodes 2a and 2c is larger than that of the coloring material particles that move from the ejection electrode 2b to the ejection electrodes 2a and 2c. As a result, the concentration of the coloring material particles in the ink droplet to be ejected is kept high.

Note that, in this embodiment, by applying the agglomeration voltage Vc immediately before application of the ejection voltage Vs, the coloring material particles are forcibly aggregated. A sufficient number of coloring material particles for ejection can be obtained within a short period of time, and the recording voltage can be applied at a relatively high ejection frequency.

Figure 6:
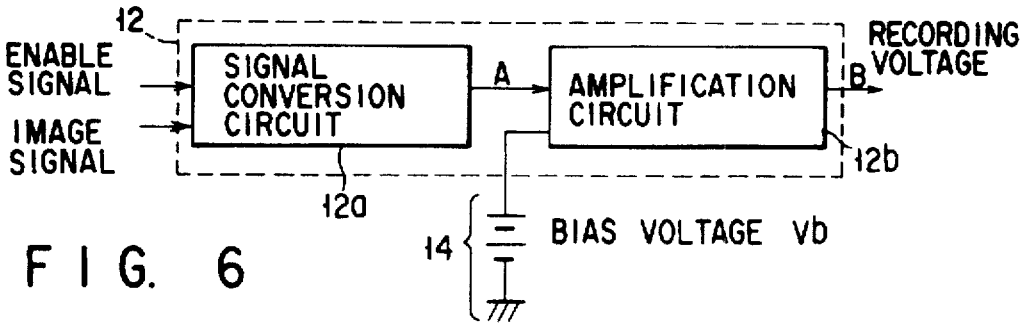
FIG. 6 is a block diagram showing a recording voltage generation section for forming the recording voltage in FIG. 4.
Figure 7:
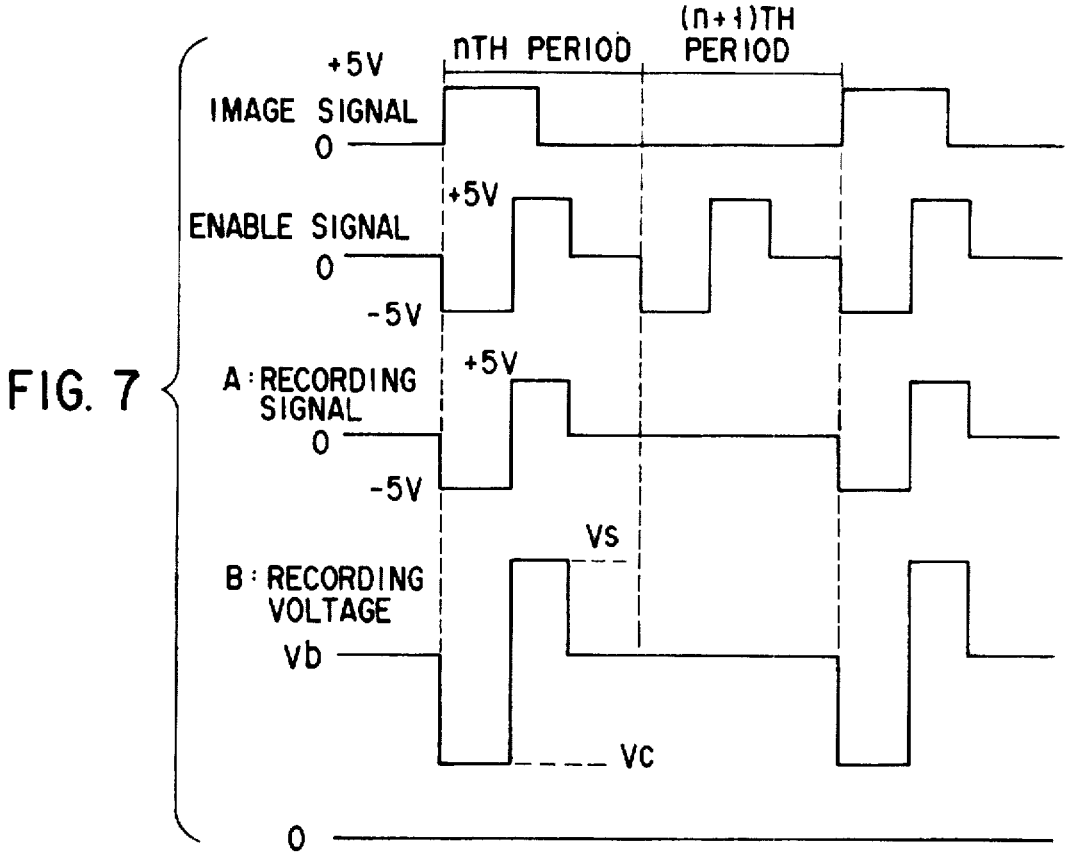
FIG. 7 is a timing chart for explaining a method of forming the recording voltage in the recording voltage generation section in FIG. 6.

Next, a method of forming the recording voltage in the above recording voltage generation section 12 will be described with reference to FIGS. 6 and 7.

The recording voltage generation section 12 comprises a signal conversion circuit 12a for forming a recording signal from an image signal supplied from an image reading section (not shown) and an enable signal, and an amplification circuit 12b for forming a recording voltage from the recording signal formed by the signal conversion circuit 12a and a bias voltage supplied from the bias power supply 14.

The enable signal is formed in an enable signal generation circuit (not shown) in accordance with an ink droplet generation frequency (5 kHz) which coincides with the frequency of the image signal. This enable signal consists of a pulse signal including a low-level pulse (60 μs) of −5 V and a high-level pulse (40 μs) of +5 V in every period (200 μs). The image signal consists of a pulse of +5 V in recording (e.g., an nth period shown in FIG. 7) and 0 V in non-recording (e.g., an (n+1)th period in FIG. 7). The enable signal and the image signal are input to the signal conversion circuit 12a in synchronism with each other, and an OR output is output as a recording signal A to the amplification circuit 12b. For example, in the nth period in which the image signal is at high level (+5 V), the recording signal A is a pulse signal in accordance with the enable signal having a low-level pulse of −5 V and a high-level pulse of +5 V. In the (n+1)th period in which the image signal is at low level (0 V), the recording signal A is at 0 V.

The amplification circuit 12b amplifies the recording signal A to a desirable voltage. In this embodiment, the amplification circuit 12b amplifies the low-level pulse of −5 V to a pulse of −500 V, and the high-level pulse of +5 V to a pulse of +500 V. The amplification circuit 12b superposes the amplified recording pulse on the bias voltage Vb (1 kV) to output a recording voltage having an agglomeration pulse with a pulse width of 60 μs and a voltage of 0.5 kV, and an ejection pulse with a pulse width of 40 μs and a voltage of 1.5 kV.

Figure 8:
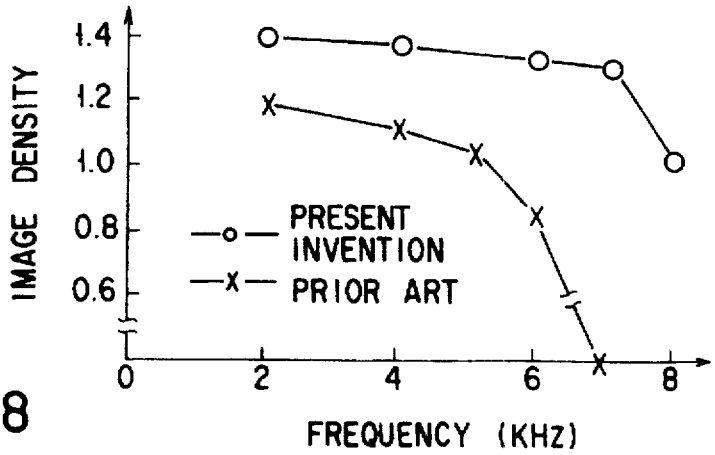
FIG. 8 is a graph showing the relationship between the ejection frequency and the image density in the recording head of FIGS. 1A and 1B.

The relationship between the ejection frequency of ink droplets in the above recording head 1 of this embodiment and the density of an image recorded by the recording head 1 will be described below with reference to FIG. 8. Note that the relationship between the ejection frequency of ink droplets and the image density according to a conventional recording method was examined for comparison.

The ejection conditions of an ink droplet by the recording head 1 of this embodiment were as follows. That is, the bias voltage Vb=1 kV, the agglomeration voltage Vc=0.5 kV, and the ejection voltage Vs=1.5 kV. The application time of the recording voltage consisting of the agglomeration voltage Vc and the ejection voltage Vs was set to be 50% the ink droplet ejection period, and the application time Tc of the agglomeration voltage Vc was set to be equal to the application time Ts of the ejection voltage Vs. The ejection conditions of an ink droplet by a conventional recording head were as follows. That is, the bias voltage vb=1 kV, the ejection voltage Vs=1.5 kV, and the application time of the recording voltage was set to be 50% the ink droplet ejection period. Note that, in each case, the ejection frequency was changed from 2 kHz to 8 kHz, and all mark recording was performed to check the image density at each ejection frequency.

The relationship between the ejection frequency and the image density was checked under the above ejection conditions. In the recording head 1 of this embodiment, the image density gradually decreased during a change in ejection frequency from 2 kHz to 7 kHz, and the degree of decrease slightly increased at 8 kHz. It is considered that the decrease in density during the frequency change from 2 kHz to 7 kHz depends on the energization time of the recording voltage, and the decrease at 8 kHz is due to unstable ejection. Therefore, the maximum ejection frequency in the recording head 1 of this embodiment is considered to be 7 kHz.

In contrast to this, in the conventional recording head, the image density decreased with a slope larger than that in this embodiment during a change in ejection frequency from 2 kHz to 5 kHz. The ink droplet ejection became unstable to abruptly decrease the density at 6 kHz, and no ink droplet was ejected at 7 kHz. Therefore, the limit of the ejection frequency in the conventional recording head is considered to be 5 kHz.

From the above results, the recording head 1 of this embodiment can form an image with a higher image density and attain a higher ink droplet ejection frequency, compared to the conventional recording head.

An image formation apparatus according to the second embodiment of the present invention will be described below with reference to FIG. 9. A basic arrangement is the same as in the first embodiment, so the same reference numerals as in the first embodiment denote the same parts in the second embodiment, a detailed description thereof will be omitted except for portions different from the first embodiment.

FIG. 9 includes a longitudinal sectional side view A of a recording head 21, a plan view B of the recording head 21, and a front view C of the recording head 21. The recording head 21 comprises an insulating base 24 on which a plurality of ejection electrodes 22 are formed, and an insulating top plate 28 on which a common electrode 26 is formed. The insulating base 24 and the insulating top plate 28 are arranged such that the ejection electrodes 22 oppose the common electrode 26. A gap about 1 mm in height serving as an ink flow path 30 is defined by the insulating base 24 and the insulating top plate 28.

A rear end side 30*a* of the ink flow path 30 is connected to an ink supply apparatus (not shown), and ink is supplied from this supply apparatus to the ink flow path 30. The ink used in this embodiment is identical to the ink used in the first embodiment. A grounded platen roller 16 is set ahead of the distal end of the ink flow path 30, as in the first embodiment. A paper sheet P is interposed between the platen roller and the recording head 21 while being wound around the platen roller, and moved in the same manner as in the first embodiment. Note that the distance between the distal end of each ejection electrode 22 and the platen roller 16 is set at 0.5 mm.

The ejection electrodes 22 are formed like the ejection electrodes 2 in the first embodiment. Ejection points 23 formed at the distal end portions of the ejection electrodes 22 are aligned horizontally, and the ejection electrodes 22 are aligned to be electrically independent from each other. Each ejection electrode 22 is uniform in width at a portion where the ejection electrode 22 opposes the common electrode 26, and is tapered such that its width gradually decreases at the distal end portion where the common electrode 26 is not present. The common electrode 26 is formed as an electrode of one metal film obtained by vapor-depositing a metal such as aluminum or gold on the insulating top plate 28. The ejection electrodes 22 and the common electrode 26 are arranged opposite to each other such that the tapered distal end portions of the ejection electrodes 22 project ahead from the common electrode 26.

The ejection electrodes 22 are connected to a recording voltage generation section 12 and a bias power supply 14 for applying a predetermined potential to each ejection electrode through an IC (not shown), respectively. The common electrode 26 is connected to a DC power supply 27 through an IC (not shown). Note that the ejection electrodes 22, the bias power supply 14, the common electrode 26, and the DC power supply 27 constitute a localization means of the present invention.

Note that coloring material particles dispersed in the ink are charged or chargeable to the same polarity as that of the potential to be applied to the ejection electrodes 22 and the common electrode 26. In this embodiment, the coloring material particles are positively charged in advance.

Next, the recording operation of the recording head 21 having the above arrangement will be described with reference to FIGS. 10 to 12. Note that this embodiment is characterized in that the coloring material particles are localized in the ink before supply of the ink to the ejection points 23.

FIG. 10 is a flow chart for explaining the recording operation of the recording head 21. At the start of the recording operation, first, the coloring material particles in the ink supplied into the ink flow path 30 are localized at the ejection points 23 of the ejection electrodes 22, as shown in step 1. Then, as shown in step 2, the coloring material particles are allowed to move to a certain ejection electrode selected in accordance with an image signal. Finally, as shown in step 3, an ink droplet is caused to fly from the ejection point 23 of the selected ejection electrode. Note that the steps 2 and 3 indicate the agglomeration and ejection operations of the coloring material particles in the first embodiment.

The steps will be sequentially explained below. First of all, step 1 (localization of coloring material particles) will be described in detail with reference to FIGS. 11A and 11B. FIG. 11A shows the state of the coloring material particles in the ink when no potential is applied to the ejection electrodes 22 and the common electrode 26. During no application period of an external force such as an electric field, the coloring material particles are uniformly dispersed in an insulating liquid due to the function of a dispersant or the like and the electrostatic repulsion force between the coloring material particles.

FIG. 11B shows the state of the coloring material particles in the ink when a bias voltage Vb is applied to the ejection electrode 22, and a DC voltage Vp smaller than the bias voltage Vb is applied to the common electrode 26. In this embodiment, a bias voltage Vb of 1.5 kV is applied to the ejection electrodes 22, while a DC voltage Vp of 1.3 kV is applied to the common electrode 26. Note that the bias voltage Vb an the DC voltage Vp are always applied even if no recording voltage is applied to the ejection electrodes 22.

By applying the bias voltage Vb and the DC voltage Vp in this manner, a bias electric field (see FIG. 5A) is formed at the ejection points 23 as in the first embodiment, and a potential difference is generated between the ejection electrodes 22 and the common electrode 26. Accordingly, the positively charged coloring material particles move to the low-potential side (common electrode 26 side) due to an electrophoretic effect.

The ink is supplied from the ink supply apparatus (not shown) into the ink flow path 30 by a hydrostatic pressure or a low-pressure pump. When the ink flows toward the distal end of the ink flow path 30 under pressure, the coloring material particles are localized and flow on the common electrode 26 side due to the influence of the electric field between the ejection electrodes 22 and the common electrode 26. In addition, the coloring material particles are influenced by a counter electrode 9 ahead of the distal end of the common electrode 26. For this reason, the coloring material particles are localized and flow along an ink meniscus 32 formed between the distal end of the common electrode 26 and the distal ends of the ejection electrodes 22 to be supplied to the ejection points 23 at the distal ends of the ejection electrodes 22.

In this manner, the potential difference Vb–Vp formed between the ejection electrodes 22 and the common electrode 26 functions to form a concentration difference of the coloring material particles in the direction of depth of the ink flow path 30. The coloring material particles are efficiently conveyed with a high concentration in the ink on the common electrode 26 side, and further conveyed to the ejection points 23 ahead of the distal end of the common electrode 26 with a high concentration on the ink surface side.

In the vicinity of the ejection points 23, the coloring material particles are subjected to a strong electrostatic attraction force of the platen roller 16 due to the concentrated electric field between the sharp distal ends of the ejection electrodes 22 and the platen roller 16. The coloring material particles therefore collect to the ejection points 23 at the distal ends of the ejection electrodes 22 and their concentration increases at the ejection points 23. The coloring material particles collected at the small ejection points 23 form an agglomeration of the collected coloring material particles.

The above-described motion, so-called localization, of the coloring material particles in the ink occurs at every ejection electrodes 22.

Next, step 2 (movement of coloring material particles) and step 3 (ejecting of coloring material particles) will be described with reference to FIG. 12. A case in which a recording voltage is selectively applied to a central ejection electrode **22*b* of three adjacent ejection electrodes 22** will be explained.

First of all, after the localization of the coloring material particles is attained at the ejection points 23 as described above, a recording voltage is applied from the recording voltage generation section 12 to the ejection electrode **22*b*** selected in accordance with an image signal. In this case, as for the recording voltage, the bias voltage Vb=1.5 kV, the agglomeration voltage Vc=1 kV, the ejection voltage Vs=2 kV, and the application time Tc of the agglomeration voltage was set to be equal to the application time Ts of the ejection voltage. The application time of a recording pulse consisting of a pulse of an agglomeration voltage (agglomeration pulse) and a pulse of an ejection voltage (ejection pulse) was set to be 50% one energization period of the recording period.

When a 1-kV agglomeration voltage Vc is applied to the ejection electrode **22*b* with a predetermined pulse width, the coloring material particles move to the ejection electrode 22*b* from adjacent ejection electrodes 22*a* and 22*c*, as shown in FIG. 12B. That is, when an agglomeration voltage Vc (1 kV) smaller than a bias voltage Vb (1.5 kV) is applied to the ejection electrode 22*b*, the potential of the ejection electrode 22*b* becomes lower than that of the ejection electrode 22*a* and 22*c*. Consequently, an electric field pointing toward the central ejection electrode 22*b* from the adjacent ejection electrodes 22*a* and 22*c* is generated. Accordingly, the positively charged coloring material particles are forced to move toward the low-potential ejection electrode 22*b* and collect at the ejection electrode 22*b***.

When an ejection voltage Vs (2 kV) is applied to the ejection electrode **22*b* immediately after the application of the agglomeration voltage Vc, a strong electric field is generated pointing from the ejection electrode 22*b* to the platen roller 16, as shown in FIG. 12C. Due to this strong electric field, the coloring material particles further move to the distal end portion of the ejection electrode 22*b*. Once an electrostatic force expressed by the product of the electrical charge of the coloring material particles and the formed electric field exceeds the surface tension of the ink, an ink droplet forms and flies toward the platen roller 16**.

In this case, some of the coloring material particles at the ejection electrode **22*b* move toward the adjacent ejection electrodes 22*a* and 22*c*. However, since coloring material particles have aggregated at the ejection electrode 22*b* in advance upon application of the agglomeration voltage Vc, the concentration of the coloring material particles at the ejection electrode 22*b*** does not decrease.

In this embodiment, the coloring material particles are localized at the ejection point 23 of the ejection electrodes 22 before application of the recording voltage to the selected ejection electrode **22*b***. Therefore, the concentration of the coloring material particles in the ink to be ejected is kept higher than that in the first embodiment. Also in this embodiment as in the first embodiment described above, a high ejection frequency can be obtained, as a matter of course.

The relationship between the ejection frequency of ink droplets at the above recording head 21 of the second embodiment and the density of an image recorded by the recording head 21 will be described below with reference to FIG. 13. Note that the relationship between the ejection frequency of ink droplets and the image density according to a conventional recording method was examined for comparison, like the first embodiment.

The ejection conditions of an ink droplet by the recording head 21 of this embodiment were as follows. That is, the bias voltage Vb=1.5 kV, the agglomeration voltage Vc=1 kV, and the ejection voltage Vs=2 kV. The application time of the recording voltage consisting of the agglomeration voltage Vc and the ejection voltage Vs was set to be 50% the ink droplet ejection period, and the application time Tc of the agglomeration voltage Vc was set to be equal to the application time Ts of the ejection voltage Vs. The ejection conditions of an ink droplet by a conventional recording head were set to be the same as in the first embodiment. Note that, in each case, the ejection frequency was changed from 2 kHz to 10 kHz, and all mark recording was performed to check the image density at each ejection frequency.

The relationship between the ejection frequency and the image density was checked under the above ejection conditions. In the recording head 21 of this embodiment, the image density gradually decreased during a change in ejection frequency from 2 kHz to 8 kHz, and the degree of decrease slightly increased at 10 kHz. It is considered that the decrease in density during the change in frequency from 2 kHz to 8 kHz depends on the energization time of the recording voltage, and the decrease at 10 kHz is due to unstable ejection. Therefore, the maximum ejection frequency in the recording head 21 of this embodiment is considered to be 8 kHz.

In contrast to this, in the conventional recording head, the image density decreased with a slope larger than that in this embodiment during a change in ejection frequency from 2 kHz to 5 kHz. The ink droplet ejection became unstable to abruptly decrease the density at 6 kHz, and no ink droplet was ejected at 7 kHz. Therefore, the limit of the ejection frequency in the conventional recording head is considered to be 5 kHz.

From the above results, the recording head 21 of this embodiment can form an image with a higher image density and attain a higher ink droplet ejection frequency, compared to the conventional recording head.

Note that the present invention is not limited to the above embodiments, and various changes and modifications are deemed to lie within the spirit and scope of the present invention. For example, the bias voltage need not always be applied. Alternatively, an agglomeration voltage may be applied to set a certain ejection electrode selected in accordance with an image signal so as to set the potential of the selected ejection electrode lower than that of the counter electrode, and immediately thereafter an ejection voltage higher than the agglomeration voltage and capable of ejecting the coloring material particles may be applied.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An image forming method comprising the steps of:

supplying an ink prepared by dispersing charged coloring material particles in an insulating liquid, to each of first and second ejection electrodes arranged to be adjacent to each other and to face a counter electrode on which a recording medium is placed;

aggregating the coloring material particles in a vicinity of said first ejection electrode by forming a first electric field between said first ejection electrode and said second ejection electrode supplied with the ink in the supplying step respectively, said first electric field directed from said second ejection electrode toward said first ejection electrode; and ejecting the coloring material particles aggregated in the vicinity of said first ejection electrode in the aggregating step, towards said recording medium by forming a second electric field between said first ejection electrode and said counter electrode.

2. A method according to claim 1, further comprising the step of forming a third electrical field directed from a third ejection electrode towards said first ejection electrode, said third ejection electrode being arranged to oppose to said second ejection electrode via said first ejection electrode.

3. A method according to claim 1, wherein said first and second electric fields are formed by selectively applying a voltage to said first ejection electrode in accordance with an image signal, in said aggregating and ejecting steps.

4. An image forming method comprising the steps of:

supplying an ink prepared by dispersing charged coloring material particles in an insulating liquid, to each of first and second ejection electrodes arranged to be adjacent to each other and to face a counter electrode on which a recording medium is placed;

a first aggregating step for collecting the coloring material particles at one end of each of said first and second ejection electrodes supplied with ink in the supplying step, respectively, by forming a first electric field, said first electric field directed from said first and second ejection electrodes toward said counter electrode;

a second aggregating step for collecting the coloring material particles in a vicinity of said first ejection electrode, by forming a second electric field between said first ejection electrode and said second ejection electrode, said second electric field directed from said second ejection electrode toward said first ejection electrode; and ejecting the coloring material particles collected in the vicinity of the end of said first ejection electrode in the first and second aggregating steps, towards said recording medium by forming a third electric field between said first ejection electrode and said counter electrode.

5. A method according to claim 4, further comprising the step of forming a fourth electrical field directed from a third ejection electrode towards said first ejection electrode, said third ejection electrode being arranged to oppose to said second ejection electrode via said first ejection electrode.

6. A method according to claim 4, wherein said second and third electric fields are formed by selectively applying a voltage to said first ejection electrode in accordance with an image signal, in said second aggregating and ejecting steps.

7. A method according to claim 4, wherein a first bias voltage is supplied to said first and second ejection electrodes in said aggregating step, and a second bias voltage which is lower than the first bias voltage, is supplied to said first ejection electrode in said second aggregating step.

8. A method according to claim 7, wherein a third bias voltage which is higher than the first bias voltage, is supplied to said first ejection electrode in said ejecting step.

9. A method according to claim 4, wherein said ink is supplied to said first and second ejection electrodes in said ink supplying step while the coloring material particles are biassed within said insulating liquid.

10. An image forming apparatus comprising:

a plurality of ejection electrodes arranged in parallel to each other, each having an ejection point situated to be spaced apart from a recording medium by a predetermined distance;

ink supply means for supplying an ink prepared by dispersing charged coloring material particles in an insulating liquid, to said each ejection point;

first bias voltage apply means for applying a first bias voltage having a same polarity as that of said coloring material particles, to said plurality of ejection electrodes;

second bias voltage apply means for applying a second bias voltage which is lower than said first bias voltage to one of said plurality of ejection electrodes, which is selected in accordance with an image signal, so as to collect said coloring material particles in a vicinity of said selected one of ejection electrodes; and third bias voltage apply means for applying a third bias voltage which is higher than said first bias voltage to said selected one of ejection electrodes, so as to eject said collected coloring material particles towards said recording medium.

11. An apparatus according to claim 10, wherein a voltage difference between said first bias voltage and said second bias voltage is larger than a voltage difference between said first bias voltage and said third bias voltage, and the pulse width of said second bias voltage is larger than that of said third bias voltage.

12. An apparatus according to claim 10, further comprising localization means for biasly dispersing the coloring material particles within said ink supplied to said each ejection point by said ink supply means, so as to guide the particles to said each ejection point.

13. An apparatus according to claim 12, wherein said localization means has a common electrode opposing said each ejection electrode via said ink supply means, and applies a DC voltage smaller than said first bias voltage, to said common electrode.

14. An apparatus according to claim 13, wherein a distal end portion of said each ejection electrode, which projects over said common electrode, has a converging tapered shape whose width gradually reduces towards an end.

15. An image forming apparatus comprising:

ink supply means for supplying an ink prepared by dispersing charged coloring material particles in an insulating liquid, to each of first and second ejection electrodes arranged to be adjacent to each other and to face a counter electrode on which a recording medium is placed;

agglomeration means for aggregating the coloring material particles in a vicinity of said first ejection electrode, by forming a first electric field between said first ejection electrode and said second ejection electrode, supplied with the ink by the ink supply means respectively, said first electric field directed from said second ejection electrode toward said first ejection electrode; and ejecting means for ejecting the coloring material particles aggregated in the vicinity of said first ejection electrode by the agglomeration means, towards said recording medium by forming a second electric field between said first ejection electrode and said counter electrode.

16. An image forming apparatus comprising:

ink supply means for supplying an ink prepared by dispersing charged coloring material particles in an insulating liquid, to each of first and second ejection electrodes arranged to be adjacent to each other and to face a counter electrode on which a recording medium is placed;

first agglomeration means for collecting the coloring material particles at one end of each of said first and second ejection electrodes supplied with ink by the ink supply means, respectively, by forming a first electric field, said first electric field directed from said first and second ejection electrodes toward said counter electrode;

second agglomeration means for collecting the coloring material particles in a vicinity of said first ejection electrode, by forming a second electric field between said first ejection electrode and said second ejection electrode, said second electric field directed from said second ejection electrode toward said first ejection electrode; and ejecting means for ejecting the coloring material particles collected in the vicinity of the end of said first ejection electrode by the first and second agglomeration means, towards said recording medium by forming a third electric field between said first ejection electrode and said counter electrode.

* * * * *